US008690260B1

(12) United States Patent
Stolarczyk

(10) Patent No.: US 8,690,260 B1
(45) Date of Patent: Apr. 8, 2014

(54) MINING MACHINE AUTOMATION

(71) Applicant: Larry G. Stolarczyk, Raton, NM (US)

(72) Inventor: Larry G. Stolarczyk, Raton, NM (US)

(73) Assignee: Stolar, Inc., Raton, NM (US)

( * ) Notice: Subject to any disclaimer, the term of this patent is extended or adjusted under 35 U.S.C. 154(b) by 0 days.

(21) Appl. No.: 13/794,842

(22) Filed: Mar. 12, 2013

(51) Int. Cl.
*E21C 35/00* (2006.01)

(52) U.S. Cl.
USPC ..... 299/1.1; 299/1.2

(58) Field of Classification Search
USPC ..... 299/1.05, 1.1, 1.2
See application file for complete search history.

(56) References Cited

U.S. PATENT DOCUMENTS 3,793,627 A * 2/1974 Darrel et al. ..... 340/680
4,189,183 A * 2/1980 Borowski ..... 299/1.6
4,733,914 A * 3/1988 Kogelmann ..... 299/81.2
4,968,098 A * 11/1990 Hirsch et al. ..... 299/1.1
7,066,555 B2 * 6/2006 Hansen et al. ..... 299/39.8
7,659,847 B2 * 2/2010 Bausov et al. ..... 342/22
8,250,786 B2 * 8/2012 Hall et al. ..... 37/465

* cited by examiner

*Primary Examiner* — John Kreck
(74) *Attorney, Agent, or Firm* — Richard B. Main; Main Law Firm

(57) ABSTRACT

An automated coal mining system outfits rotating cutterhead drums with bit blocks and replaceable bit picks according to a lacing pattern. A set of strain gauges are configured to measure the mechanical forces experienced by the bit picks during coal cutting. Measurements are taken that can be processed for indications that the replaceable bit picks have encountered a boundary layer of rock during coal cutting operations, or they are working harder than necessary to cleave coal, or that a better lacing pattern is possible. A resonant microwave patch antenna is mounted on a top surface shoulder of the bit blocks to take impedance measurements of the coal face. The impedance measurements are calibrated according to indications that the replaceable bit picks have encountered a boundary layer of rock. The rotating drum sensor data is wirelessly transmitted back to the machine for analysis and control purposes.

7 Claims, 7 Drawing Sheets

200
224
230
bit block
Horizon
Sensor
patch
antenna
202
216
water manifold
210
212
213
206
214
204
208
cutterhead
drum
220
coal
bed
222
boundary
rock
226
218

MINING MACHINE AUTOMATION

RELATED APPLICATION

This Application claims benefit of U.S. Provisional Patent Application Ser. 61/675,855, filed Jul. 26, 2012, and titled, HYDRAULIC DRILLSTRING SOUND GENERATOR; and, U.S. Provisional Patent Application Ser. 61/675,838, filed Jul. 26, 2012, and titled, SMART COAL CUTTING DRUM. Such are incorporated herein, in full, by reference, as is U.S. patent application Ser. No. 13/561,390, filed Jul. 30, 2012.

BACKGROUND OF THE INVENTION

1. Field of the Invention

The present invention generally relates to automated coal mining, tools, equipment, and methods, and more particularly to using force measurements obtained from individual bit picks in bit blocks on continuous and longwall mining machine coal cutterhead drums to reduce the generation of coal cleaving fines, to automatically calibrate earth-penetrating radars, and to predict the best orientations, lacing patterns, and positions for replacement bit picks and cutterhead drums at a next service interval.

2. Background of the Invention

The coal fines and dust produced by continuous and longwall mining machines in underground coal operations is hazardous for a number of reasons. So the reduction and control of such coal fines and dust can go a long way towards improving coal mining safety and the health of miners. One obvious way to control coal fines and dust has been to spray them and the cutting faces with water. So it is common practice now to provide water passages in cutterhead drums and bit blocks, and spray nozzles. The water also helps to cool the machinery, the cutting face, and to quench any tendency to spark or burn.

The angles and forces with which the bit tips strike and re-strike the coal face to cleave off blocks and sheets of raw coal have an effect on the amount of coal fines and dust produced by continuous and longwall mining machines. Too much force will crush and pulverize the coal at the points of impact. Subsequent strikes that do not follow the original fractures produced by the initial strikes wastes machine energy and reduces the flaking size. Such can also increase the wear and tear experienced by the equipment.

The Colorado School of Mines and the 20-Mile Coal Company studied this problem and published their paper, *Results of Practical Design Modifications for Respirable Dust Reduction on Continuous Miners in Underground Coal Mining*, by Brian Asbury, et. al., at the SME Annual Meeting, Feb. 24-26, 2003, Cincinnati, Ohio. They report that about a third of all coal production in the United States comes from underground mines. Essentially all underground coal production is produced by continuous miners and longwall mining machines. Much of the respirable dust produced by cutting drums is generated by material that is crushed directly under the individual bits on the cutterhead. They say that the tip angle, angle of attack, bit penetration, and other cutting geometries all affect the volume of fines and dust that will be generated under an individual cutter bit. Reducing the number of cutters engaging the rock by increasing the bit spacing will also reduce the total amount of fines and dust generated.

FIG. 1 repeats and adds to what was presented by Brian Asbury, et. al., in their Paper. The cutting direction is lateral to the exposed face of the coal. The cutter bit will present a force normal to the face and a cutting force lateral to the face in the cutting direction. Such cutter bit will have a rake and clearance angles relative to the cuts. The depth of cut is "d". Fractures will radiate from a crushed zone. Each strike of a cutter bit advances the cleaving of material off the face.

If a next cutter bit strikes the propagating fractures in the butt-face cleat coal structure, coal fines can be reduced. The Paper suggests that fines are produced in the crushed zone. If a next cutter bit manages to strike on the propagating fracture, the crush zone will not be as large. Coal fails at approx 2500 psi. The Paper contends that fines can be reduced by reducing the number and increasing the separation between bit blocks. But no mention is made of the coal butt-face cleat structure. In the pick and shovel days, the pick force vector was directed into the vertical face cleat, enabling a peeling off of blocks of coal. Picking squarely into the butt cleats seemed to absorb the energy better and not break.

A coal shearer travels along the face of a coal seam with a large drum or cutting head, slicing off slabs of coal with dozens of replaceable picks. Shearers use different types of drums, and the picks are available in a wide variety of styles, designs, uses, and materials. A conventional pick-flushing drum sprays water through nozzles mounted on top of the cutter drum vanes, e.g., pick face flushing (PFF), and pick back flushing (PBF). The sprays wet the dust particles as soon as the picks strike the coal and cut it. The water naturally gets mixed in with the cut coal as it is discharged from the drum.

Water is often added to the tires of mine sweeping vehicles. Such significantly reduces the available explosive energies by absorbing the energy in the heat of fusion process by changing the phase state of water to gas. If a hydrocarbon (methane gas) ignition occurs in a coal mine, especially when cutting into sandstone boundary rock, water can be placed to absorb significant amounts of the ignition energy.

Shearers are used that can cut coal in unidirectional and bidirectional patterns. Unidirectional cutting is the most common type of cutting pattern used in longwall mining in the United States. The shearer moves from tailgate entry to headgate entry. A leading drum is raised to cut coal while a trailing drum cuts the floor coal. Cleanup is done on each return trip back along the face. In bidirectional cutting, a web width of coal is cut in both directions of travel. Each pass uses two-faced end operations to turn the machine around.

Coal shearers use conveyor belt systems to transport the cut coal away from the face after it is cut. Armored face conveyors move under the shearers to collect the coal as it is cut. Three types of coal shearers are used in longwall mining. Double-ended ranging drum shearer (DERS) can extract coal from seams 58-156 inches thick. When the seam thickness exceeds 60 inches the entire coal seam can be cut in one pass of the machine and in either direction of travel enabling a higher level of productivity and shorter roof exposure time. Two single-ended ranging drum shearer (SERS) machines are used simultaneously on longwall faces with a 60 inch mining height. Two single-ended fixed drum shearer (SEFS) machines are used simultaneously on longwall faces to extract thin coal seams of a 48 inch thickness.

Philip W. Southern thought the solution to controlling dust in longwall coal mining was to eliminate the unnecessary sharp edges in the construction of the bit block mounts and vanes on the cutter drums. U.S. Pat. No. 5,230,548, titled LONGWALL CUTTER DRUM HAVING REDUCED PROPAGATION OF DUST, was issued Jul. 27, 1993. A cutter drum is described that presents smoothed surfaces that will not create dust when falling pieces of coal hit them. The claim is made that the new drum requires less energy to operate because the resistance to rotation is reduced.

The "technical root cause" of lung disease reported in the Upper Big Branch accident investigation was the HS boundary detection technology gap, that if crossed, would have prevented the rotating drum picks "blind" cut into seam boundary rock of the undulating and faulted coal seam. Undulations in the coal bed horizon are influenced by differential compaction of meandering paleochannels, faults, dykes, and other types of depositional anomalies. The point of sensing must be in-real time (i.e., on the cutting drum) and not delayed in time by sensing on the body of the mining machine.

To avoid cutting into the seam boundary rock caused by a meandering paleochannel seam role, the machine automated cut algorithm must begin with the downward floor cut ahead of the paleochannel margin to safely mine through a differentially compacted seam anomaly. The "last cut memory" horizon control algorithms are not useful in automated control of the shearer in undulating environment.

In geologically disturbed environments, the coal shearer operator needs to be to see the machine. Thin layers of uncut roof coal are used for ground control to prevent rock fall into the mining face. The thin seam boundary coal layer is contaminated with biochemically reduced forms of heavy metals.

For example, Felish Peng found 25 to 680 pounds/$10^{12}$ Btu in boundary layer channel samples, which compares to 6.1 pounds in the body of the seam. Of course, splay-deposits may restart contamination in mid-seam. Heavy metal contamination and silica in respirable dust are drivers in lung disease. Researchers now realize that lung disease causes may include the heavy metals as well as silica dust reactions that diminish lung tissue oxygen transfer into the blood stream.

A serious environmental threat to the industry is the promulgation of rules declaring boiler fly ash toxic because of the re-oxidation of heavy metals in the combustion process. Because of boundary ground control and contamination issues, synthesized picks detection is of value only in interface detection. From a health and safety point of view, thin contaminated boundary coal layers should be left behind in the mine.

David Chang determined that a small gap in a loop of wire will exhibit a resonant driving point impedance ($Z_{1N}$) that depends on the thickness of any slightly conducting Earth dielectric positioned next to the loop antenna. Chang and Wait formulated equations governing such gap impedance which is a complex variable satisfying the Cauchy-Riemann conditions.

The conventional GPR antenna distance to the coal rock boundary is oftentimes less than 0.2 meter. The radar electromagnetic (EM) wave field components roundtrip travel time is less than two nanoseconds that creates a detection and interpretation problem for conventional GPR. The circuital wire loop, which would never withstand the drum-cutting environment, was replaced with a resonant microstrip patch antenna (RMPA). Dr. Peter Petrov and his colleges formulated the EM equations and computer code to predict the RMPA impedance change with a varying and slightly conducting Earth dielectric. As it turns out, the theoretical physics of Maxwell, Heaviside, and von Hippel was required to combat the effects of the rotating picks fracturing of the thin coal boundary layer and water spray changing the dielectric constant of the slightly conducting coal layer.

To combat the state-of-the-art interface varying dielectric calibration problem, new radar technology was developed and in-mine demonstrated in Consol and the Oxbow coal mines. This work solved the problematic geologic clutter (e.g., rapid spatial change in dielectric constant) and very high reflection in the "early arrival time" that obscures "late arrival time" EM field components reflected from air or water filled entries.

The double sideband gradiometer (DSBg) ground penetrating radar (GPR) technology was developed on a highwall mining machine and horizontal drill string navigation collar enabled distance determination relative to the seam boundary. Our early DSBg GPR work resulted in a validated prototype.

The SCARE functionally was developed to suppress the clutter and reflection from the pick fractured coal layer and detect the EM field components reflected from the coal-rock interface and even a gradational boundary. The double sideband gradiometer (DSBg) GPR with SCARE functionality suppresses early arriving EM wave field components (ER1) by up to seventy dB relative late arriving field components (ER2) from the coal-rock boundary interface. The suppression depth can be selected by the adjusting the modulation frequency, which is one-half of the sideband frequency separation. The fracture suppression depth is set to approximately the pick length. By including a bit force vector sensor in the bit block, the interface pick intersection can be determined. It's used for automated calibration, controlling the rock cutting depth when required, and to acquire data for bit lacing for minimum fines production.

Sometimes it is necessary to cut through the contaminated coal layers and into the boundary rock, e.g., for machine clearance. Bit blocks with piezoelectric sensors can be used to measure the bit tip force vectors and determine bit contacts with the rock interface. The rock cut depth can thereafter be accurately and automatically controlled by the machine.

Dust produced by cutting drums is generated by rock and coal that is crushed directly under the individual bits on the rotating cutter head. The pick tip angle of attack, bit penetration, and drum lacing pattern affects the fines and dust generated. A pick bit block, instrumented with piezoelectric sensors, was developed and trialed in a pick cutting force measuring apparatus. The objective of the work was to measure the pick vector force angle in real time. Reducing the number of picks on the drum and increasing pick bit bock spacing was suggested by the CSM work to reduce fines and dust.

There are a number of conventional devices and methods that claim dust and fines reduction (e.g., very smooth drum surfaces and shaped picks). Coal fracturing is dependent on the cleat geometry and microfractures induced by horizontal platonic forces relative to the vector pick force angle and propagating fracture angle. Reduction in coal fines occurs when the next pick intersects the propagating fracture. Measurement of vector pick angle and uncut coal thickness data can be transmitted by radio modem to the shearer.

The uncut coal DSBg GPR with SCARE functionality will look up to detect the condition of roof support canopy loss of hydraulic pressure and look forward to detect abandoned hydrocarbon well casings. The multiple-mode smart coal cutting drum data will be transmitted from the rotating drum to the mining machine and processed. The acquired data will enable optimization of coal cutting for minimum fines generation.

SUMMARY OF THE INVENTION

Briefly, an automated coal mining system embodiment of the present invention outfits a continuous miner and longwall mining machine and its rotating cutterhead drums with bit blocks and replaceable bit picks according to a lacing pattern. A set of strain gauges are configured to measure the mechanical forces experienced by the bit picks during coal cutting.

Measurements are taken that can be processed for indications that the replaceable bit picks have encountered a boundary layer of rock during coal cutting operations, or they are working harder than necessary to cleave coal, or a better lacing pattern is possible. A resonant microwave patch antenna is mounted on a top surface shoulder of the bit blocks to take impedance measurements of the coal face. The impedance measurements are calibrated according to indications that the replaceable bit picks have encountered a boundary layer of rock.

These and other objects and advantages of the present invention will no doubt become obvious to those of ordinary skill in the art after having read the following detailed description of the preferred embodiments that are illustrated in the various drawing figures.

IN THE DRAWINGS

Figure 3:
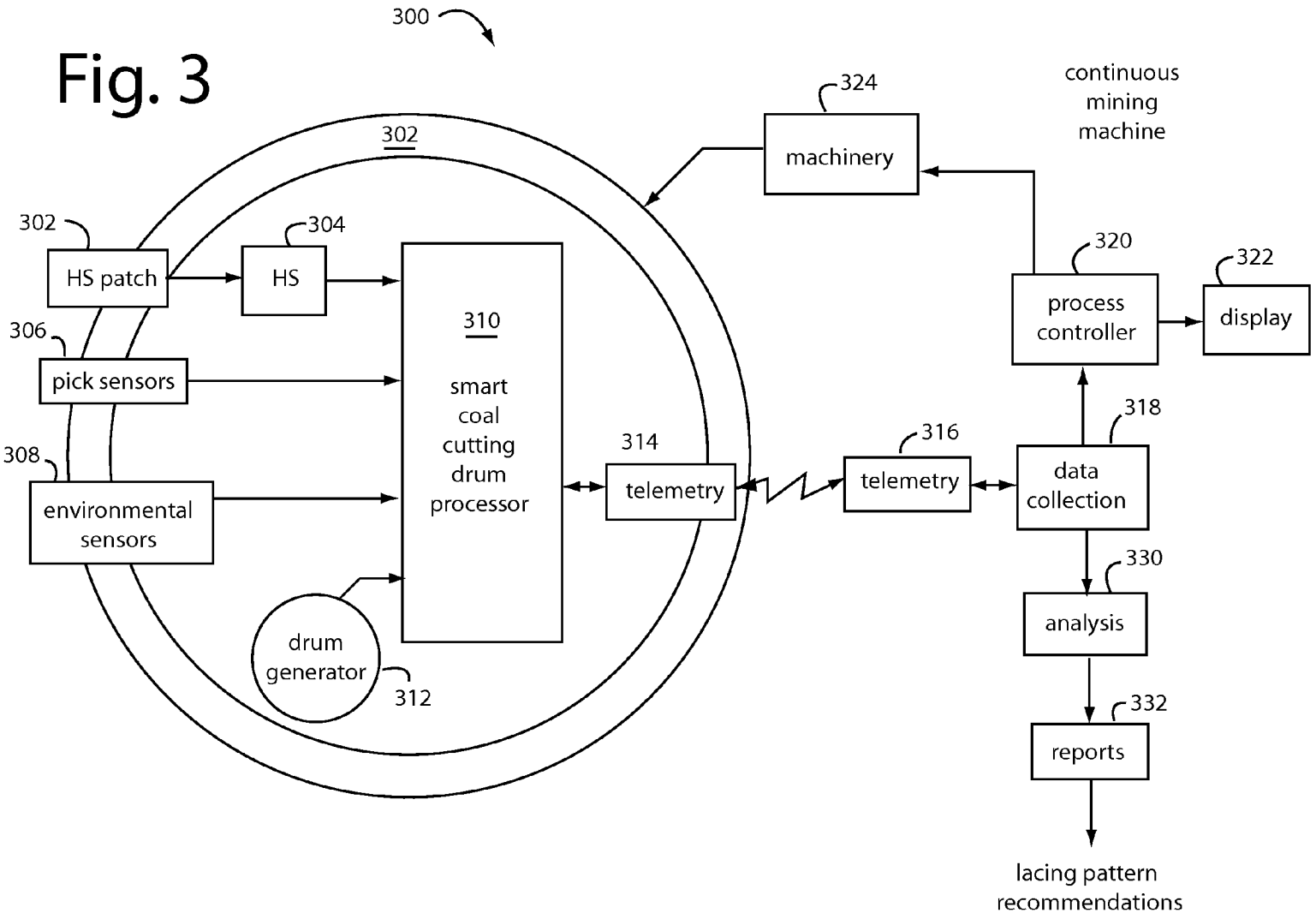
FIG. 3 is a schematic diagram of a smart coal cutting drum system including the elements of FIGS. 1 and 2 and further including processors, controllers, displays, and analysis needed to automate the cutting of high quality coal and to do it safely with reduced hazards to the operators.
Figure 4:
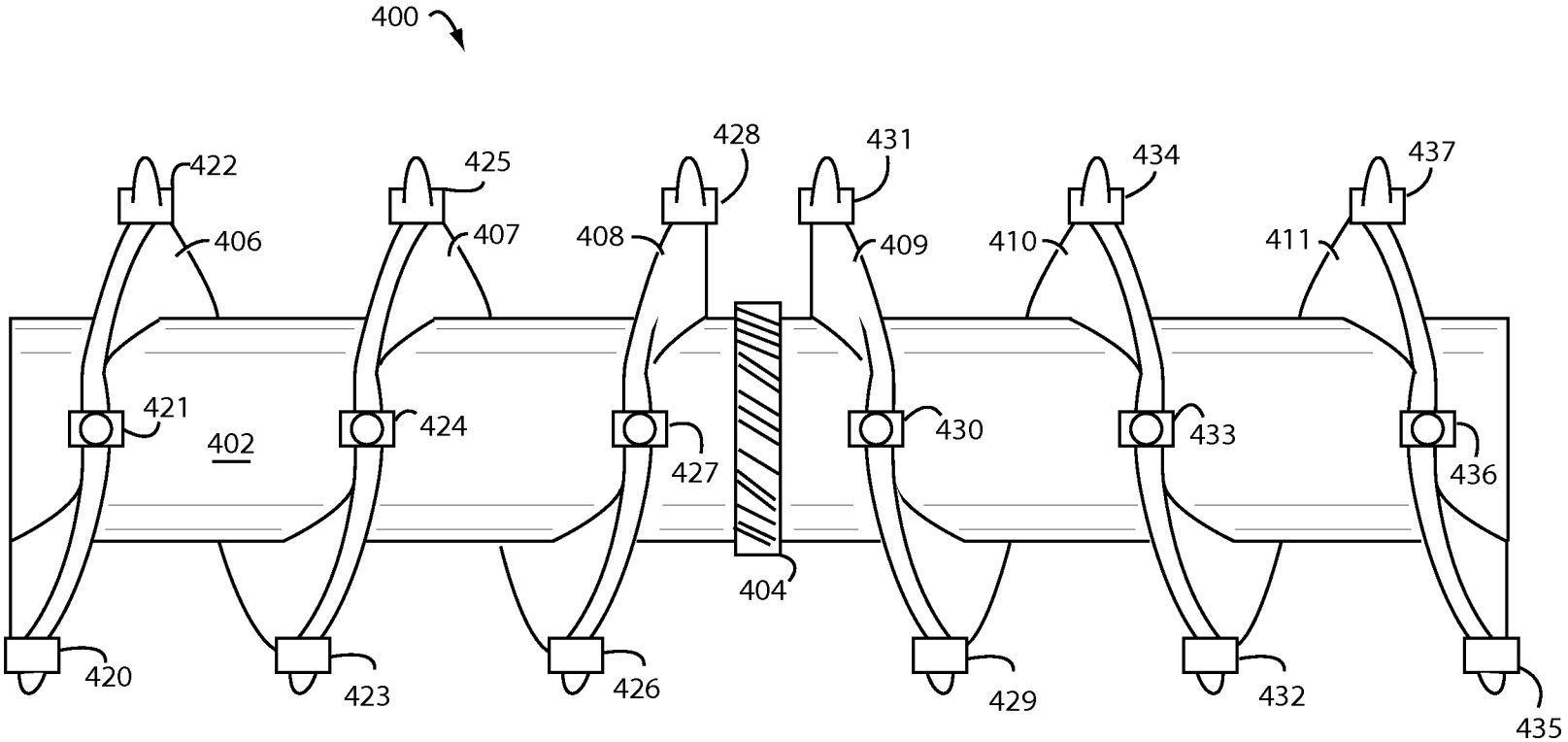
FIG. 4 is a front view diagram of a coal cutterhead drum including many of the elements of FIGS. 1-3, and in particular showing how the bit picks and bit blocks are mounted on the tops of vanes and form a lacing pattern.
Figure 5A:
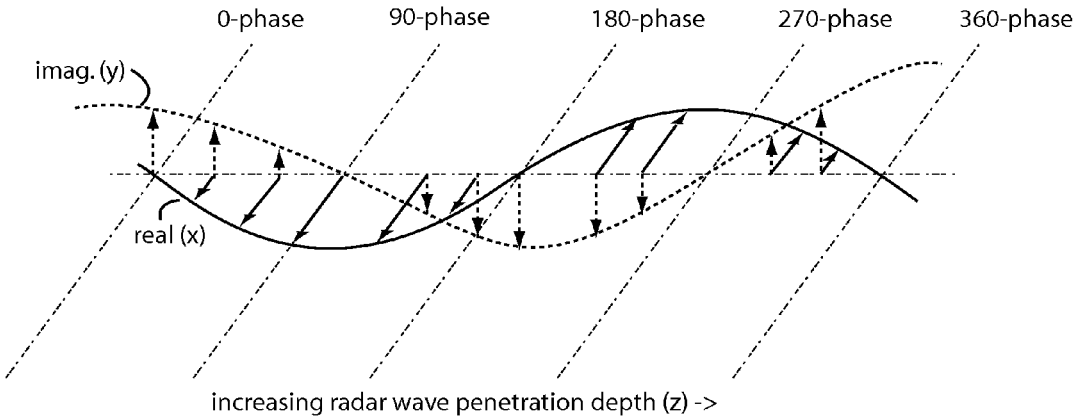
FIG. 5A represents the real (in-phase, I) and imaginary (quadrature-phase, Q) parts of the electro-magnetic (EM) wave reflected back the radar antenna when radiating into the interface separating natural media of differing impedance.
Figure 5B:
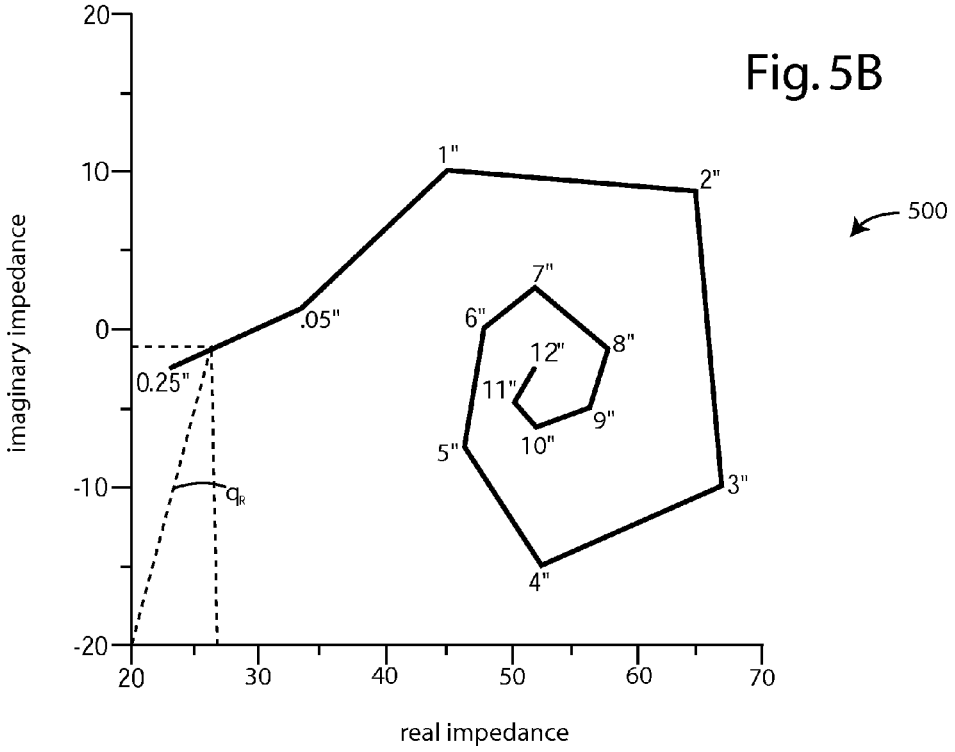
Figure 5C:
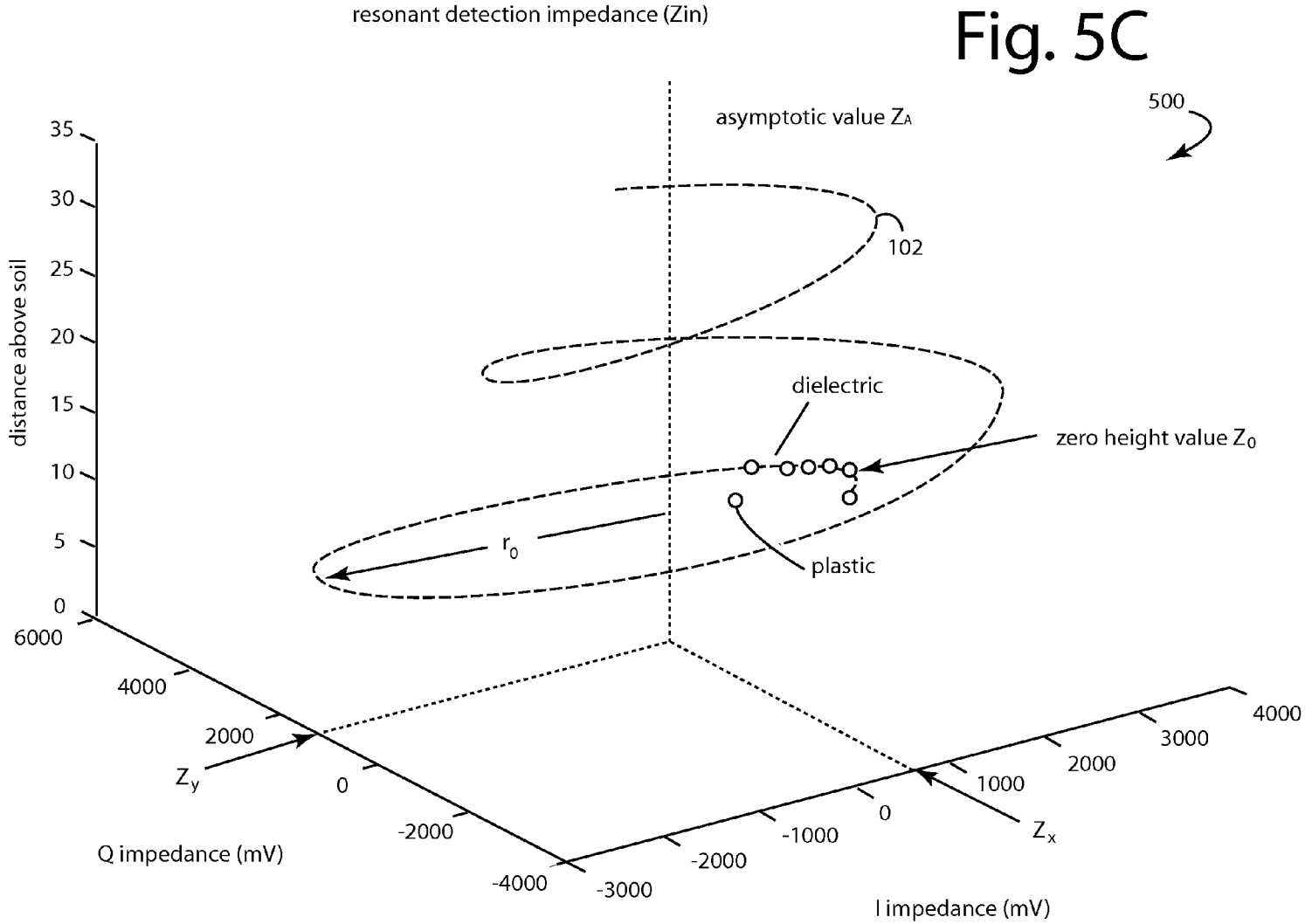
Figure 6A:
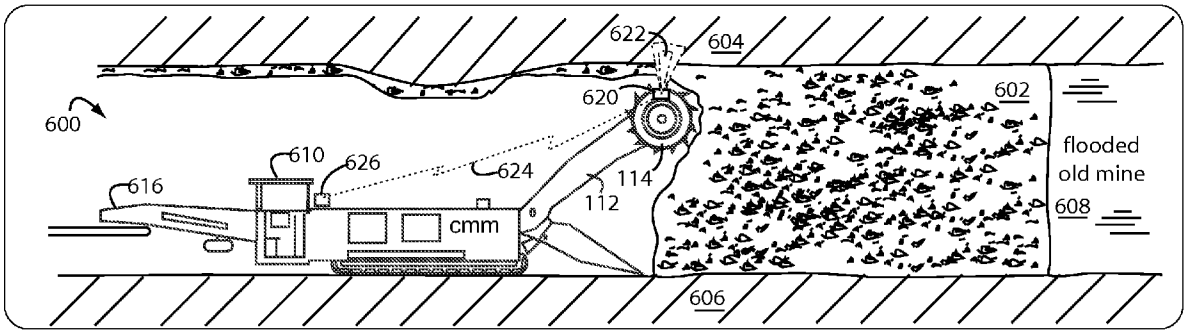
Figure 6B:
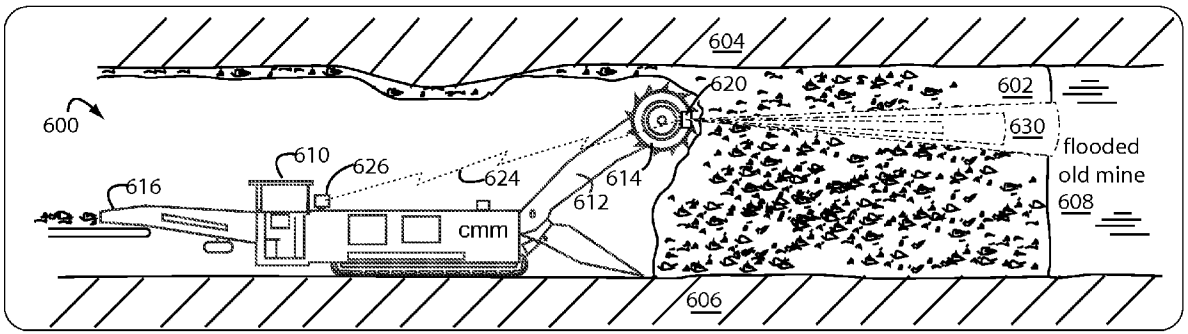
Figure 6C:
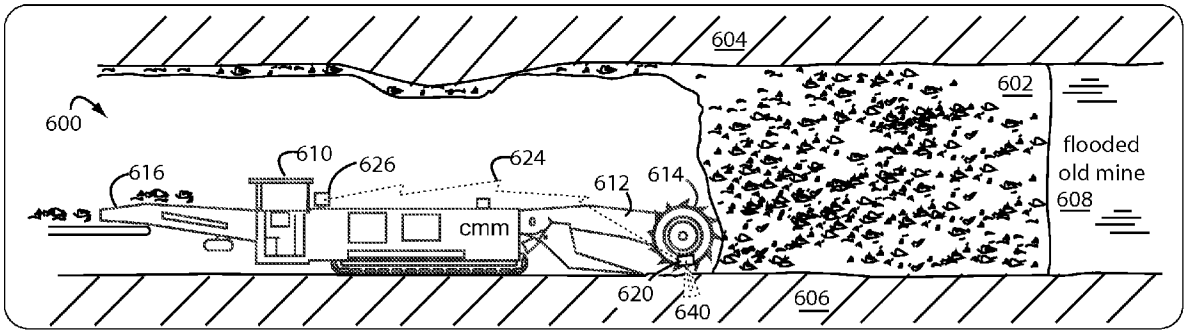

FIG. 5B charts the relationships that typically develop between the RMPA antenna and the depth to the object and measured values for real (in-phase, I) and imaginary (quadrature-phase, Q). The two vector components of RMPA impedance, real and imaginary, are orthogonal and vary differently as the remaining thickness of a nearby coal layer changes. Plotting the imaginary on the Y-axis and the real on the X-axis of a graph yields a calibration curve that spirals to a vanishing point with increasing layer thickness;

FIG. 5C is a three dimensional chart of the changes in real (Zx) and imaginary impedances (Zy) that occur in the input impedance of a resonant microwave patch antenna (RMPA) kept in resonance at various heights above the soil; and FIGS. 6A-6C are side view diagrams of a continuous mining machine equipped with the smart coal cutting drums and systems of FIGS. 1-4 and 5A-5B. The continuous mining machine is shown operating in a cutaway view of an underground coal mine where the cutterhead drum is cutting coal from the roof in FIG. 6A, from the coal face in FIG. 6B, and from the floor in FIG. 6C.

DETAILED DESCRIPTION OF THE PREFERRED EMBODIMENTS

Embodiments of the present invention are an advance Stolar horizon sensing technology. A resonating microstrip patch antenna (RMPA) is integrated into a bit block following the pick receiver. Such location presses the RMPA into the coal cut, fractured, and wet coal layer. SCARE spatial suppression of the early-to-arrive EM field components with respect to the later arriving reflected field components enables advanced automation of coal cutting machines while increasing miner health and safety. For construction details on the spatial suppression, see our U.S. Pat. No. 7,656,342, issued Feb. 2, 2010, titled, DOUBLE-SIDEBAND SUPPRESSED-CARRIER RADAR TO NULL NEAR-FIELD REFLECTIONS FROM A FIRST INTERFACE BETWEEN MEDIA LAYERS. Such is incorporated herein by reference, in full.

Embodiments of the present invention have "rejection zones" tunable to the depths subject to clutter and/or unimportant dielectric variations. Dangerous and harmful objects will be deeper, in the layers usually obscured by the strong radar reflections conventional radars suffer coming from the coal face. The double sideband gradiometric (DSBg) methods employed here can achieve up to 70-dB of clutter rejection, thus improving mining performance.

Embodiments of the present invention do not strictly employ radar. They do not depend on the receipt of an echo signal and the measurement of the roundtrip time the echo signal took to return after the original pulse was transmitted.

Instead, embodiments of the present invention include automatic frequency or trimming controls to keep a continuous wave (CW) transmission tuned to the resonant frequency of a resonant microwave patch antenna (RMPA). Changes in loading and the bulk dielectric constant of the mixed media in front of the RMPA will affect the resonant frequency and the input impedance.

In effect, the embodiments electronically measure the bulk dielectric constant of a cone of earth directly under a downward pointing RMPA. If such cone of earth has no large air-filled voids, like a tunnel, then one result will be obtained. But if there is a substantial air-filled void, the bulk dielectric measurement of a cone of earth that includes it will be significantly different. If these contrasting differences track as linear segments projected to the ground surface, they can be interpreted as an indication that a void or bulk dielectric object exists. When RMPA's with resonant frequencies of 150-MHz are used, the useful sensitivity of such a system to locate objects can reach thirty feet or more into the earth.

The advanced double sideband gradiometer (DSBg) ground penetrating radar (GPR) with SCARE functionality designs typical include 24-bit analog-to-digital (A/D) conversion, and a field-programmable gated-array (FPGA) with advanced microprocessor program up load, fast digital signal processing, and a radio frequency modem. Flameproof enclosures are drum mounted with barrier strips approved by the Federal MSHA. Pick bit block piezoelectric sensors are submitted to MSHA for intrinsic safety (IS) certification. The SCARE functionality is made possible by phase coherent heterodyne synchronization with a state-of-the-art digital low phase jitter crystal clock of −108 dB with respect to the synchronizing signal.

Imbedded control and processing software for the SCARE functionality uses bit pick vector force measurements, filtering, and Fourier and Laplace transform analysis between the time and frequency domains. Non-linear stress fields in the coal load release heterodyne acoustic band frequencies that can be processed in both the time and frequency domains when crossing geologic fractures to determine the direction cosines of the pick vector force. Pick intersections with the coal-rock interface are used for self-calibration of the Horizon Sensor uncut coal layer thickness and depth of cut into the rock for machine clearance.

Smart coal cutting drum system embodiments of the present invention take measurements of the force vectors being experienced by replaceable bit picks mounted to their respective bit blocks on the outside surface of a rotating coal cutting drum of continuous and longwall mining machines. A resonant microwave patch antenna (RMPA) of a Stolar Horizon Sensor is nested into a wide shallow well in the shoulder of the bit blocks just aft of the bit pick sockets. This new location for the patch antenna closes up the air gap to the cut coal that previously existed when the Horizon Sensor was disposed flush in a pocket in the drum surface. The measurements and coal thickness calibration table obtainable by the Horizon Sensor are therefore much improved over our prior art.

A very detailed description of the Horizon Sensor has been published in *Horizon Sensor for Advanced Coal Extraction* (*ACE*), by Dr. Larry G. Stolarczyk and Gerald L. Stolarczyk; Raton Technology Research, Inc. Raton, N. Mex.; and, Kenneth L. Perry Salt Lake City, Utah; Presented at National Mining Association MINExpo International '96 Sep. 11, 1996 Las Vegas, Nev. http://www.stolarhorizon.com/PDFs/HORIZON-SENSOR-COAL-EXTRACTION.pdf This new way to instrument a rotating coal cutting drum provides three opportunities. First, strain gauges fitted in the bit pick sockets of the bit blocks provide realtime data that can be interpreted to locate the transitions between cutting coal and cutting boundary rock. The impedance measurements obtained by the Horizon Sensor at that point are calibrated as zero uncut coal thickness. The cutter is then mechanically repositioned five inches away and a second impedance measurement is taken. This second measurement is scaled as five inches of uncut coal thickness. Mining thereafter can therefore proceed under the automatic guidance of the Horizon Sensor by maintaining a continual, optimal cut 5-8 inches from the boundary rock. Such calibrations can be continuous and ongoing without any need to stop mining.

Second, data from the strain gauges and Horizon Sensor are telemetered back to the mining machine from its rotating cutting drum together with temperature, gas detector, and other measurements. In particular, the strain gauge data obtained from each bit pick is collected and analyzed to determine how well the bit picks are cleaving the coal off the face. Optimum cleaving will produce minimum coal fines, extend bit pick life, and reduce the horsepower needed to drive the drum.

Third, the data collected and analyzed from the bit pick strain gauges is used to suggest optimum lacing pattern orientations for each new bit picks as they are periodically replaced when the machine is stopped and serviced. Each bit pick has a tilt to it relative to its bit block socket that can be rotated and locked into an optimum longitudinal and lateral angle of attack on the coal face.

The bit block strain gauges data annunciates when the bit tip ring intersects the coalbed boundary, or that significant wear to at least one replaceable bit pick and the machine operation should be automatically halted.

The depth of the rock cut can be controlled by collecting the ranging arm angle with the body of the machine and the pitch, yaw and roll angles. Algorithmic processing and control of the machine with such bit sensing capabilities prevents the cut into the coal seam boundary. Otherwise, the coal quality would suffer by increased ash and the heavy metals in the run of mine coal.

Any rock mined increases belt wear, increases plant waste rock and reduces clean coal yields. An important aspect of using bit block sensors is self calibration of the HS is made possible. The coal boundary is sensed by a rapid increase in strain. The horizon sensor patch antenna impedance exhibits a spiral versus uncut coal thickness function, that has been reported in previous patents. Collecting the intercept impedance initializes the zero uncut coal thickness of the curve. Moving the machine back a preset distance provides impedance measurements that can be used to calibrate the HS. The calibration of the machine can be accomplished in real time without interfering with coal production.

Figure 1:
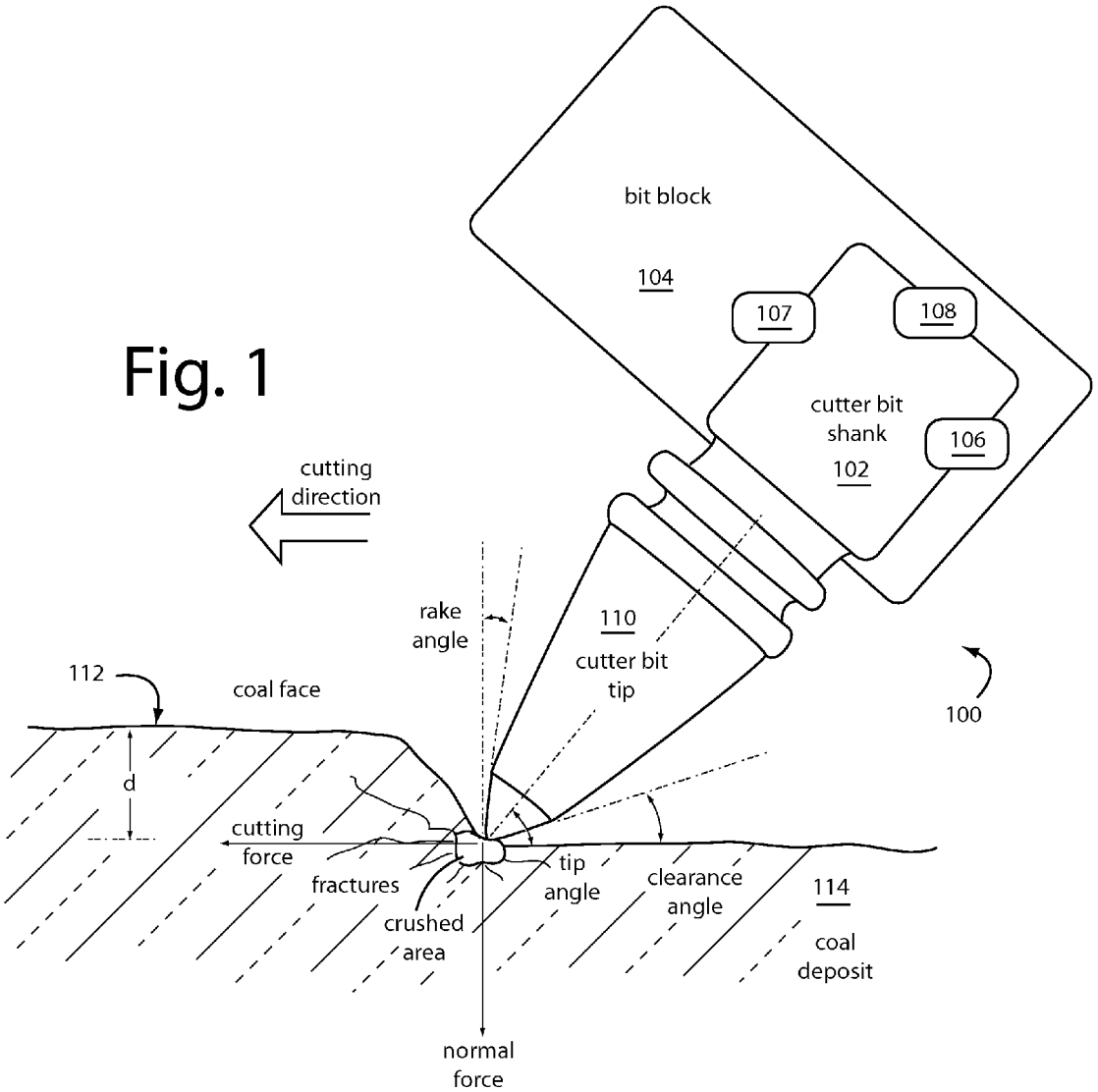
FIG. 1 is a diagram of a bit pick embodiment of the present invention showing how a coal face is cut, cleaved of coal, fractures, and can produce fines and dust.

FIG. 1 represents a bit pick embodiment of the present invention, and is referred to herein by the general reference numeral 100. A cutter bit shank 102 is configured to be mounted by a socket in a bit block 104 on a coal cutterhead or drum. Such socketed connection is fitted with several strain gauges 106-108 to measure the three dimensional forces applied to a cutter bit tip 110 during coal cutting. These strain gauges 106-108 report the cutting forces and normal force being applied by the cutter bit tip 110 as it fractures and cuts though a coal face 112. A natural coal deposit 114 will have an extensive matrix of cleats, fissures, and fractures that can be exploited to reduce fines and dust generation during coal cutting. The strain gauges 106-108 can provide realtime operational data that is used to assess cutter bit performance and the character of the coal deposit under the bit. The realtime operational data can also be collected and analyzed to predict if improvements could be made by installing different types of cutter bit tips 110, setting different angles, using different pressures, and configuring alternative bit lacing patterns on the cutterhead or drum.

The bit block sensor signals can be expected to be very noisy, especially when the pick loads up in cutting and then intersects a fracture and it's non-linear stress field. Such signals require processing to determine the spectral density frequency distributions. The type of material, e.g., coal, sandstone, shale, etc., can be determined from spectral analysis using algorithmic code. The pick force vectors are processed in an algorithmic code to determine optimum lacing patterns that may be available to minimize coal particles and fines. Optimized lacing patterns also can promise minimum cutting energy efforts.

Figure 2:
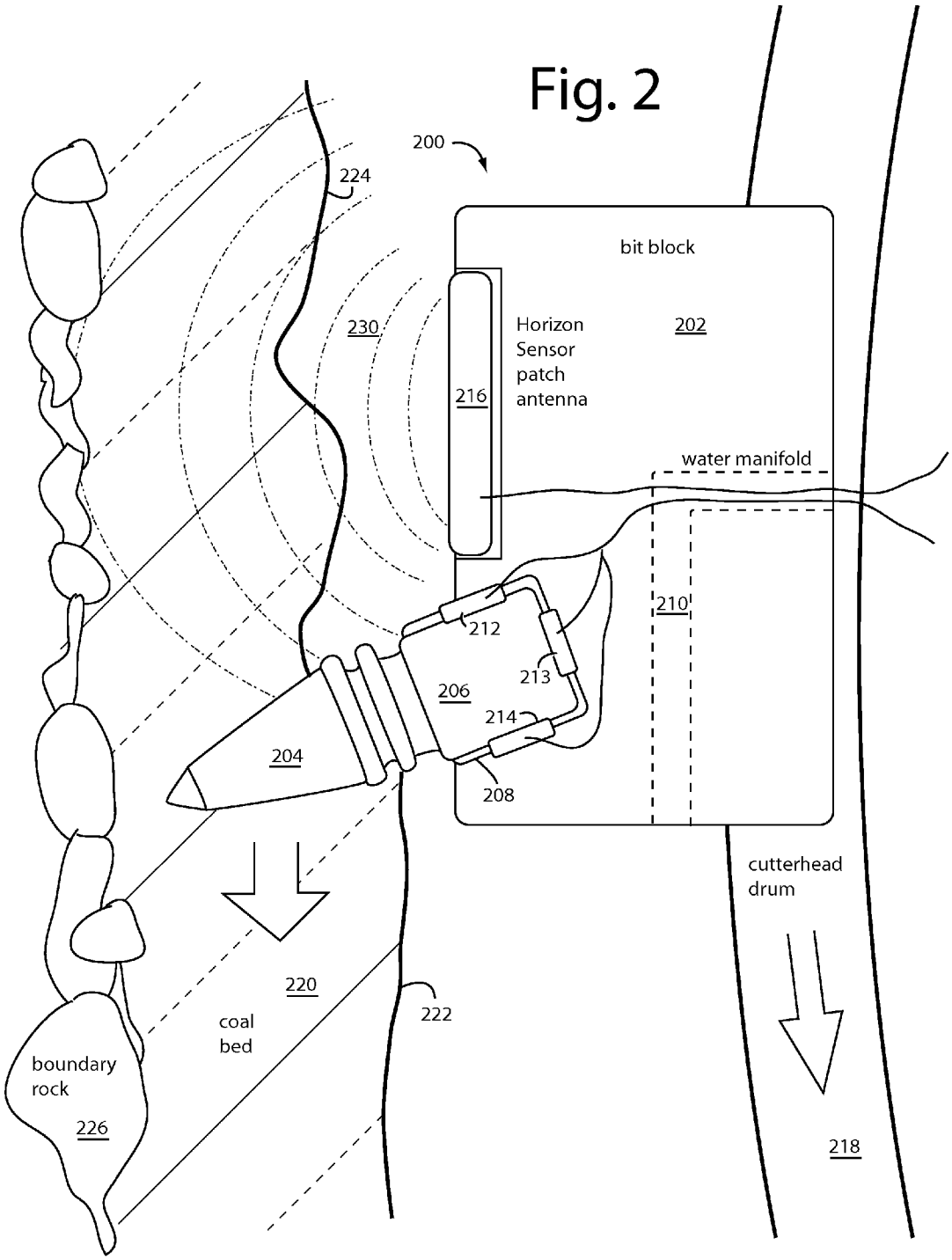
FIG. 2 is a more diagram of a bit pick, bit block, and Horizon Sensor in a system embodiment of the present invention, and shows how a boundary layer of rock behind a coal face can be imaged and avoided by automatic controls.

FIG. 2 represents a smart coal cutting drum embodiment of the present invention, and is referred to herein by the general reference numeral 200. Smart coal cutting drum 200 includes a bit block 202 that carries a replaceable bit pick 204 by a shank 206 in a socket 208. A water manifold 210 is drilled into the bit block 202 normally to conduct spray water and coolant, but here it is also used for wiring conduit. Several strain gauges 212-214 are fitted into bit pick socket 208 to measure the forces experienced by bit pick 204 during coal cutting. A Horizon Sensor (Stolar Research, Raton, N. Mex.) resonant microwave patch antenna (RMPA) 216 is mounted behind protective ceramic covers in a milled out well aft of bit pick 204 and its socket 208. For example, the RMPA 216 is mounted on a top surface shoulder of bit block 202.

The bit block 202 is welded to a cutterhead drum 218 along with others aligned to form a particular lacing pattern of cutters on the drum 218. Small adjustments in the lacing patterns are possible after assembly by replacing bit picks 204 with others that have different geometries, tilts, and materials.

The position shown for the Horizon Sensor patch antenna 216 in FIG. 2 is new, it puts the sensor much closer to coal bed 220 and its cut faces 222 and 224 by moving it up onto the pedestal offered by the bit block 202. Thus an air gap 226 is reduced and Horizon Sensor sensitivity is improved over flush mounting it father away in the conventional location on the drum in a surface pocket.

A boundary rock layer 230 will usually mark the limits of how far coal cutting can proceed. The few inches of coal nearest the boundary rock layer 230 is usually of poor quality due to contaminations, so best mining practice is to leave it be.

It is also quite important to safety to keep bit pick 204 away from and prevent its striking boundary rock layer 230. Silica dust and sparks can result that are hazardous to the miners. So the Horizon Sensor and its patch antenna 216 are used to automate and control how close cutterhead drum 218 is allowed to encroach on boundary rock layer 230. In order to do that properly, the impedance measurement obtained by the Horizon Sensor and its patch antenna 216 need to be calibrated.

One method of calibration is to deliberately move a rotating cutterhead drum 218 into coal bed 220 enough for bit picks 204 to strike the boundary rock layer 230. The strain gauges 212-214 will at that point provide output signals that are characteristic of such contact. This point is calibrated to zero by marking the impedance measurement then obtained by the Horizon Sensor and its patch antenna 216. The cutterhead drum is mechanically moved away from this zero point by five inches, for example. A second impedance measurement taken is calibrated to be five inches on a scale. The Horizon Sensor and its patch antenna 216 are thereafter able to provide realtime calibrated measurements of the distance through coal layer 220 to boundary rock layer 230. On-the-fly recalibrations are made possible by smart coal cutting drum 200.

FIG. 3 represents a continuous mining machine embodiment of the present invention, and is referred to herein by the general reference numeral 300. Continuous mining machine 300 includes a cutterhead drum 302 outfitted, as in FIG. 2, with at least one patch antenna 302 connected to a Horizon Sensor 304, bit block pick strain gauge sensors 306, and an environmental sensor 308 to measure temperature, gases, humidity, etc. A smart coal cutting drum processor 310 is fully disposed inside the cutterhead drum 302 and is powered by a drum generator 312. There are no signal or power wires from the cutterhead drum 302 to the rest of the continuous mining machine 300. All are intrinsically safe and/or enclosed in explosion proof enclosures. A telemetry transceiver 314 wirelessly communicates with a similar telemetry transceiver 316 on the main chassis of the machinery, and provides data and information developed by the smart coal cutting drum processor 310 to a data collection unit 318.

Smart coal cutting drum processor 310 includes calibration processes for the Horizon Sensor 304. It further includes processes to cleanup, amplify, filter, interpret, and abstract the signals received from bit block pick strain gauge sensors 306. The environmental measurements obtained by environmental sensor 308 are more or less passed through to the telemetry channel.

A process controller 320 works interactively with a user display 322 to control the machinery 324. Such machinery includes the hydraulics needed to start, stop, raise, lower, advance, retreat, and turn cutterhead drum 302. At a minimum, smart coal cutting drum processor 310 provides realtime information and graphics for user display 322 to help the operator understand the coal bed in front of the cutterhead drum 302, its environment, and forces on the bit picks. The operator is then better informed to operate the machinery more safety, more efficiently, and more productively.

The data collected and analyzed from the bit pick strain gauges is used to suggest optimum lacing pattern orientations for each new bit picks as they are periodically replaced when the machine is stopped and serviced. Each bit pick has a tilt to it relative to its bit block socket that can be rotated and locked into an optimum longitudinal and lateral angle of attack on the coal face.

Data collection unit 318 also provides information about the picks to an analyzer 330. It compares current strain gauge readings and trends pick-by-pick to identify changes and out-of-bounds conditions that need more immediate attention, e.g., a broken pick. Long term analysis is made of all the picks together to judge whether different lacing patterns of bit blocks on the drums would be better.

Some lacing pattern changes are easier to accomplish than others. For example, adding or removing picks from already existing bit blocks or changing the type of picks. Gross changes like relocating the bit blocks themselves are harder to do because the bit bits are welded to the tops of the vanes and the vanes are part of the drum's base structure. The data obtained from analyzer 330 can be put into a periodic report by a reporter 332 and used by a manufacturer of cuttinghead drums to design a new drum with a suggested lacing pattern that would be more appropriate to a particular mine given the data obtained.

FIG. 4 represents a smart coal cutting drum embodiment of the present invention and is referred to herein by the general reference numeral 400. Smart coal cutting drum 400 includes a hollow cylindrical body 402 driven at the center to rotate by a gear 404. As coal is cut, a system of vanes 406-411 will gather the coal to the center where a conveyor belt will carry it away. The position and pitch of vanes 406-411 fundamentally set the lacing pattern of the bit picks and bit blocks, represented here by bit picks and bit blocks 420-437. Mining lacing patterns for continuous miner drums are discussed by Albert Dawood in United States Patent Application US 2006/0255649, published Nov. 16, 2006. The present inventors discuss this and using radar in miner drums in U.S. Pat. No. 7,659,847, issued Feb. 9, 2010, and titled RADAR MINING GUIDANCE CONTROL SYSTEM.

Each of the bit picks and bit blocks 420-437 are like those described in FIG. 2. The complete installation is as described in FIG. 3. The water manifolding and water spray system are not shown, but are usually necessary in any coal mining application to control fines and dust.

FIG. 5A represents the real (in-phase, I) and imaginary (quadrature-phase, Q) parts of a primary wave that penetrate into the earth from HS patch antenna 216 (FIG. 2). Any secondary waves reflected back from objects or other interfaces will carry I and Q phase information that is related to the depth the reflection occurred. Coherent demodulation in the radar receiver and antenna impedance measurements are used to estimate a buried target's depth. That depth would be the distance from HS patch antenna 216 to boundary rock layer 230.

FIG. 5B charts the electrical relationships that typically develop between HS patch antenna 216 and the depth to boundary rock layer 230 and measured values for real (in-phase, I) and imaginary (quadrature-phase, Q). The two vector components of HS patch antenna impedance, real and imaginary, rise and fall differently as a nearby media layer thickness changes. Plotting the imaginary on the Y-axis and the real on the X-axis of a graph yields a calibration curve 500 in FIG. 5B that spirals to a vanishing point with increasing layer thickness, e.g., from 0.25" to twelve inches.

FIG. 5C represents one key basis of functioning of embodiments of the present invention. Changes in real (Zx) and imaginary impedances (Zy) will occur in the input impedance of a resonant microwave patch antenna (RMPA) when kept in resonance at various heights above the soil. The spiral represents expected readings, outliers, barbs, and dips will occur in readings that deviate from the spiral at depths where plastics and other dielectrics are encountered.

FIGS. 5A-5C list distances in inches. These distances are determined by calibrating the Horizon Sensor when actual depths are known. Here, the zero depth can be automatically discovered by moving the drum in far enough that the boundary rock layer is contacted by bit picks and their strain gauges signal the contact. The real and imaginary impedances are measured and set as calibrations to the zero point. Thereafter, the Horizon Sensor can be called upon to provide depth measurement estimates on-the-fly.

It is presently expected that the introduction of strong acoustical vibrations to the bit picks and/or uncut coal could reduce the overall energy needed to cut and cleave coal from the coal faces. The mechanical design would be similar to the gasflow permeable intensifiers for wellbores developed in Russia and described in other patents and patent applications assigned to Stolar Research (Raton, N. Mex.). Tuning forks and their phenomenon are still another way that beneficial vibrations could be introduced to assist in coal cutting.

FIGS. 6A-6C represent a continuous mining machine (CMM) 600 equipped with one or more of the smart coal cutting drums and/or systems of FIGS. 1-4 and 5A-5B. Here, CMM 600 is shown mining a coal deposit 602 bounded by roof boundary rock layer 604 and floor boundary rock layer 606. One of the dangers that can be inadvertently encountered is an old, flooded mine works 608. A CMM operators station 610 has control over a boom 612 and the rotation of a smart coal cutting drum 614. A conveyor system 616 carries away cut coal.

In FIG. 6A, a Horizon Sensor 620 has rotated to an upward looking position. A sensing beam 622 can gauge the distance through the coal 602 to the roof boundary rock 604. A wireless link 624 connects to an operator control and display 626.

In FIG. 6B, Horizon Sensor 620 has rotated to a forward looking position. A far ranging sensing beam 630 can look deep through the coal 602 far enough to stop mining if a danger like an old flooded mine works 608 or a steel well casing lies ahead.

In FIG. 6C, Horizon Sensor 620 has rotated to a downward looking position. A sensing beam 640 can estimate for the CMM operator the distance through the coal 602 to the floor boundary rock 606.

A method embodiment of the present invention for automated coal mining starts with the outfitting of a mining machine and its rotating cutterhead drums with bit blocks and replaceable bit picks. During operation, the mechanical forces experienced by the bit picks during coal cutting are measured with bit pick strain gauges. The measurements are analyzed in realtime for indications that one or more of the replaceable bit picks have struck a metallic shield canopy of a fallen hydraulic roof support. The mining machine can be controlled to automatically stop so personnel can correct the hydraulic roof support.

A smart coal cutting drum processor can find indications in its measurement data that the replaceable bit picks have encountered a boundary layer of rock during coal cutting operations. It can also detect that the bit picks are working harder than necessary to cleave coal, and that a better lacing pattern may be possible. A set of strain gauges is configured to measure the mechanical forces experienced by the replaceable bit picks when mounted to corresponding bit blocks on a cutterhead drum for operation during coal cutting. A first lacing pattern is used to guide where to position the replaceable bit picks and corresponding bit blocks on a cutterhead drum. The mechanical force measurements are processed for telltale indications that each replaceable bit pick has been optimally positioned on the cutterhead drum, e.g., empirically coal fines and dust are at a minimum during coal cutting operations. A second lacing pattern, alternative to the first, can be tried to see if should can further minimize coal fines and dust, extend bit pick life, and/or reduce the horsepower needed to drive the cutterhead drum. An optimum lacing pattern would be determined empirically by trial and error.

A Horizon Sensor when disposed in a cutterhead drum and connected to an RMPA can be configured to provide impedance measurements having real and imaginary components to a smart coal cutting drum processor configured to interpret the collection of measurements from the set of strain gauges and estimate a series of mechanical forces experienced by replaceable bit picks during coal cutting operations. An analyzer is configured to receive interpretations and data from the smart coal cutting drum processor, and computes a second, better lacing pattern if one is possible. Reports related to the relative performance of the first and second lacing patterns are issued based on computations provided by the analyzer.

Transceivers are used for telemetering data from the strain gauges and Horizon Sensor to the mining machine from its rotating cutting drum, as well as temperature, gas, look ahead radar, and other measurements. The strain gauge data obtained from each bit pick is collected and analyzed to determine how well the bit picks are cleaving the coal off the face. Optimum cleaving substantially reduces coal fines, extends bit pick life, and reduces the horsepower needed to drive the rotating cutting drum.

Each mining machine and its rotating cutterhead drums can be outfitted with bit blocks and replaceable bit picks according to a lacing pattern. The mechanical forces experienced by the bit picks during coal cutting are measured with bit pick strain gauges. The measurements are processed for indications that the replaceable bit picks have encountered a boundary layer of rock during coal cutting operations, or that they are working harder than is necessary to cleave coal, or that a better lacing pattern is possible. As empirically observed.

A second resonant microwave patch antenna can be mounted on a top surface shoulder of the bit blocks to take impedance measurements of a coal face. The impedance measurements are then calibrated according to indications that the replaceable bit picks have encountered a boundary layer of rock. Any data collected and analyzed from the bit pick strain gauges is used empirically to compute optimum lacing pattern orientations for each new bit pick as they are periodically replaced when the continuous miner is stopped. Each bit pick is built with a tilt relative to its bit block. This then can be rotated and locked into an optimum longitudinal and lateral angle of attack on the coal face.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed:

1. An improved automated coal mining system, comprising:

a rotating cutterhead drum fitted with bit blocks and replaceable bit picks;

a set of strain gauges configured to measure a series of mechanical forces experienced by at least one replaceable bit pick mounted to a bit block on a cutterhead drum for operation during coal cutting; and a resonant microwave patch antenna (RMPA) mounted on a top surface shoulder of the bit block and configured to take impedance measurements of a coal face having a boundary layer of rock;

the improvement comprising:

a smart coal cutting drum processor connected to the RMPA and set of strain gauges, and configured to calibrate said impedance measurements according to strain gauge indications that a replaceable bit pick has encountered a boundary layer of rock, wherein the rotating cutterhead drum is thereafter enabled to automatically avoid encountering boundary layer of rock again because calibrated impedance measurements are available to provide a warning signal.

2. The automated coal mining system of claim 1, further comprising:

a Horizon Sensor disposed in the cutterhead drum and connected to the RMPA, and configured to provide impedance measurements having real and imaginary components to the smart coal cutting drum processor;

wherein, said impedance measurements are calibrated to enable the smart coal cutting drum processor to provide boundary rock layer depth estimates in realtime.

3. The automated coal mining system of claim 2, further comprising:

a process controller configured to automatically guide the cutterhead drum according to said boundary rock layer depth estimates and warning signal provided by the smart coal cutting drum processor.

4. The automated coal mining system of claim 1, further comprising:

a data collection, analysis, and reporting processor for analyzing measurement data for evidence that the replaceable bit picks have encountered a boundary layer of rock during coal cutting operations, or that the measured forces are higher than otherwise necessary to cleave coal, or that another lacing pattern has previously performed better, and configured to output a report.

5. A method for automated coal mining, comprising:

outfitting a mining machine and its rotating cutterhead drums with bit blocks and replaceable bit picks according to an empirically predetermined lacing pattern;

measuring the mechanical forces experienced by the bit picks during coal cutting with bit pick strain gauges;

processing the bit pick strain gauge measurements for indications from prior measurements that the replaceable bit picks have encountered a boundary layer of rock during coal cutting operations, or that the force necessary to cleave coal is unusual, or that other lacing patterns have required less mechanical force; and mounting and operating a resonant microwave patch antenna on a top surface shoulder of the bit blocks to take impedance measurements of a coal face;

wherein, the impedance measurements are range calibrated according to corresponding indications that the replaceable bit picks have encountered a boundary layer of rock.

6. The method of claim 5, wherein data is collected from the bit pick strain gauges and processed by an analyzer that compares current strain gauge readings and trends, pick-by-pick, to identify changes and out-of-bounds conditions that need more immediate attention, and a long term analysis is made of all the picks together to judge different lacing patterns of bit blocks on the drums as each new bit pick is periodically replaced.

7. The method of claim 5, wherein each bit pick is constructed with a tilt relative to its bit block such that it can be rotated and locked into a computed optimum longitudinal and lateral angle of attack on the coal face.

* * * * *